US010815907B2

(12) United States Patent
Oh

(10) Patent No.: US 10,815,907 B2
(45) Date of Patent: Oct. 27, 2020

(54) METHOD FOR ENGINE CONTROL BASED ON CONTROL TIMING PREDICTION AND VEHICLE THEREOF

(71) Applicants: Hyundai Motor Company, Seoul (KR); KIA Motors Corporation, Seoul (KR)

(72) Inventor: Chang-Jin Oh, Gyeonggi-do (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 48 days.

(21) Appl. No.: 16/219,086

(22) Filed: Dec. 13, 2018

(65) Prior Publication Data

US 2020/0049078 A1 Feb. 13, 2020

(30) Foreign Application Priority Data

Aug. 8, 2018 (KR) ..... 10-2018-0092365

(51) Int. Cl.
*F02D 1/18* (2006.01)
*F02P 5/04* (2006.01)
*F02D 41/00* (2006.01)

(52) U.S. Cl.
CPC ..... *F02D 1/18* (2013.01); *F02D 41/009* (2013.01); *F02P 5/045* (2013.01); *F02D 2700/10* (2013.01)

(58) Field of Classification Search
CPC .. F02D 35/028; F02D 41/009; F02D 41/0097; F02D 2200/101; F02D 2200/1012
See application file for complete search history.

(56) References Cited

U.S. PATENT DOCUMENTS 4,945,875 A * 8/1990 Akasu ..... F02P 5/1504 123/406.24
2006/0060176 A1* 3/2006 Yamashita ..... F02P 3/045 123/609

FOREIGN PATENT DOCUMENTS

JP 2017210942 A 11/2017

* cited by examiner

*Primary Examiner* — Sizo B Vilakazi
*Assistant Examiner* — Anthony L Bacon
(74) *Attorney, Agent, or Firm* — Brinks Gilson & Lione

(57) ABSTRACT

A method for engine control under an entire driving range of a vehicle based on control timing prediction implemented in the vehicle is provided, which may reduce a start angle error calculated at a calculation time prior to an operation time when actual injection and ignition is performed by grasping a tooth period change tendency for a tooth period of a current time that injector/igniter drivers of an engine control unit read from an engine position management driver and calculating a start angle of fuel injection and ignition through prediction of the tooth period to match an actual operation time. In particular, since the prediction of the tooth period to match the actual operation time is based on a change tendency of the tooth period stored up to the current time, the injection and ignition time effectively reflects an engine operation situation in which an engine RPM is changed.

11 Claims, 4 Drawing Sheets

METHOD FOR ENGINE CONTROL BASED ON CONTROL TIMING PREDICTION AND VEHICLE THEREOF

CROSS-REFERENCE TO RELATED APPLICATION

This application claims priority to Korean Patent Application No. 10-2018-0092365, filed on Aug. 8, 2018, the entire contents of which is incorporated herein by reference.

FIELD

The present disclosure relates to engine control.

BACKGROUND

The statements in this section merely provide background information related to the present disclosure and may not constitute prior art.

In general, an internal combustion engine of a vehicle operates under the control of an engine control unit, which can control fuel injection and ignition.

For this, the engine control unit includes a central processing unit controlling fuel injection and ignition with respect to an engine during vehicle drive. The central processing unit may include application software (ASW) and a driver. As an example, the driver may include an engine position management driver (EPM driver), an injector driver (INJ driver), and an ignition driver (IGN driver), and the ASW may include injector application software (INJ ASW) and igniter application software (IGN ASW).

The EPM driver can calculate and determine the position of a piston in an engine cylinder by, for example, sensing a gear tooth of a crank target wheel and an edge of a cam target wheel, and can consider a time when such determination is made as a sync time, and perform a sync task after the sync is performed.

The INJ ASW and the IGN ASW can calculate a fuel injection and ignition operation time and an end angle at a time when the sync task is performed.

The UNJ driver and the IGN driver can receive an operation time and an end angle of the INJ ASW and the IGN ASW, convert the operation time into an angle, and calculate a start angle by subtracting the converted value from the end angle. In particular, such a process may be performed twice in total: once in the neighborhood of the sync task, and once at two crank teeth before the start angle calculated through the sync task (i.e., time before 12 degrees during the angle conversion).

As described above, the engine control unit controls fuel injection and ignition during vehicle drive through functions of the ASW and the driver of the central processing unit using the end/operation time and the start angle as information.

SUMMARY

However, for accuracy of fuel injection and ignition control in the engine control unit, the start angle required from a specific sub-module may be calculated using a tooth period (i.e., time required for a rotation of one tooth) with respect to the crank tooth of a crankshaft.

As an example, in the start angle calculation procedure, the latest start angle for the start time of the injection and ignition may be calculated from the tooth period up to a time before 3 crank teeth (i.e., angle of 18 degrees), and as start angle information transferred to the central processing unit, the last calculated angle at the time after the 3 crank teeth may be confirmed as the final value of the start angle.

Accordingly, the engine control unit (ECU) should be able to accurately reflect an engine operation situation in which engine revolutions per minute (RPM) is continuously changed. This is because the change of the RPM in the engine operation situation brings a pattern change of the tooth period. Through this, the tooth period read at a calculation time when the start angle of the fuel injection and ignition is calculated may make the tooth periods and patterns differ from each other at the operation time when the actual injection and ignition are performed through driver's action to step on/off an acceleration pedal.

As a result, the injection and ignition start control of the engine control unit (ECU) performed at a result derivation time through the calculation in which such a pattern difference is not reflected may be unable to satisfy the end time and the operation time established by the application software (ASW), and thus the engine may not perform as well as possible.

The present disclosure provides a method for engine control based on control timing prediction and a vehicle thereof, which can reduce an error value of start angle calculation occurring due to a difference between a calculated time and an operation time through matching of a tooth period to a time when an actual injection and ignition is performed to control under an entire driving range of a vehicle, and in particular, which can match the start angle to the operation time when the actual injection and ignition is performed even in an operation situation in which the engine RPM is changed through prediction of the tooth period at the operation time based on a change tendency of the tooth period stored up to the current calculation time.

The present disclosure can be understood by the following description. Those skilled in the art to which the present disclosure will appreciate that aspects of the present disclosure may be realized by the means as claimed and combinations thereof.

The present disclosure provides a method for engine control under an entire driving range of a vehicle based on control timing prediction includes performing a start angle operation time prediction control predicted through a calculation in which a start angle of fuel injection and ignition for an engine matches a tooth period of an operation time with a tooth period variation acquired from a tooth period of a calculation time when an engine control unit is switched to be turned on together with a key-on of the engine.

The start angle operation time prediction control may include calculating a crank tooth corresponding to the operation time of the fuel injection and ignition, calculating a tooth period average value that is divided into a current tooth period average value and a past tooth period average value through the number of teeth read in a reverse direction from the latest calculation time, calculating the tooth period variation from the tooth period average value, calculating a future tooth period average value that matches the tooth period of the operation time from the tooth period average value and the tooth period variation, calculating the start angle corresponding to the operation time of the fuel injection and ignition, and performing the injection and ignition output at the start angle.

In one aspect of the start angle operation time prediction control, the crank tooth is converted into the number of teeth corresponding to the operation time. The current tooth period average value is calculated in consideration of the number of teeth grasped in the reverse direction from the latest calculation time as the current tooth period, and the past tooth period average value is calculated in consideration of the number of teeth grasped before the current tooth period as the past tooth period. The tooth period variation is calculated by dividing the current tooth period average value by the past tooth period average value. The future tooth period is calculated by multiplying the current tooth period average value by the tooth period group variation.

In one aspect of the start angle operation time prediction control, the start angle may be calculated by subtracting the predicted angle corresponding to the operation time from an end angle of the fuel injection and ignition. The predicted angle is calculated by dividing the operation time by the future tooth period average value. The start angle is set in a timer, and the injection and ignition output is performed to match a set time of the timer.

The tooth period of the calculation time may be calculated using an end angle and the operation time of the fuel injection and ignition, and the end angle and the operation time are calculated by performing engine start information calculation control.

The performing of the engine start information calculation control may include performing, by the engine control unit, driver sync confirmation and sync task performing with a crank signal and a cam signal of the engine, calculating the end angle and the operation time at a time of the sync task performing, and confirming the end angle and the operation time through the start angle operation time prediction control.

In one aspect of the engine start information calculation control, the crank signal is tooth sensing information of a crank target wheel attached to a crankshaft, and the cam signal is edge sensing information of a cam target wheel attached to a cam shaft. The sync confirmation is performed at a position determination time of a piston in a cylinder of the engine, and the sync task performing is performed as many as the number of cylinders in one cycle of the engine.

In another aspect, a vehicle may include an engine control unit to control under an entire driving range of the vehicle composed of an engine position management driver, an injector application, an ignition application, an injector driver, and an igniter driver, wherein the injector driver and the igniter driver read a tooth period of a current time from the engine position management driver, and calculate a start angle of fuel injection and ignition in a future tooth period to match an actual operation time based on a tooth period change tendency of a calculation time.

The engine position management driver may be provided with a buffer configured to store the tooth period as an index.

The engine control unit may include a timer module, and the timer module sets a start angle timer time for an injection and ignition output with calculation values of the injector driver and the igniter driver.

The engine control applied to the vehicle according to the present disclosure may use the start angle through the control time prediction, and thus implement the following operations and effects.

First, since the tooth period used for the start angle that is calculated and converted from the end angle and the operation time of the fuel injection and ignition is predicted, the start angle calculation error is reduced. Second, since the prediction of the tooth period is based on a change tendency of the tooth period stored up to the current time, it is possible to reflect the difference in period pattern between the calculation time and the actual operation time due to the driver's manipulation of the accelerator pedal in the calculation. Third, the accuracy of the calculation of the injection and ignition start time can be greatly heightened. Fourth, since the end time and the operation time of the fuel injection and ignition intended during the engine control is observed, engine performance control may improve. Fifth, since the application software (ASW) and the driver constituting the engine control unit (ECU) observe the requirements in accordance with the set logic, it becomes possible to improve engine control.

It is to be understood that both the foregoing general description and the following detailed description of the present disclosure are exemplary and explanatory and merely provide further explanation of the disclosure as claimed.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1A:
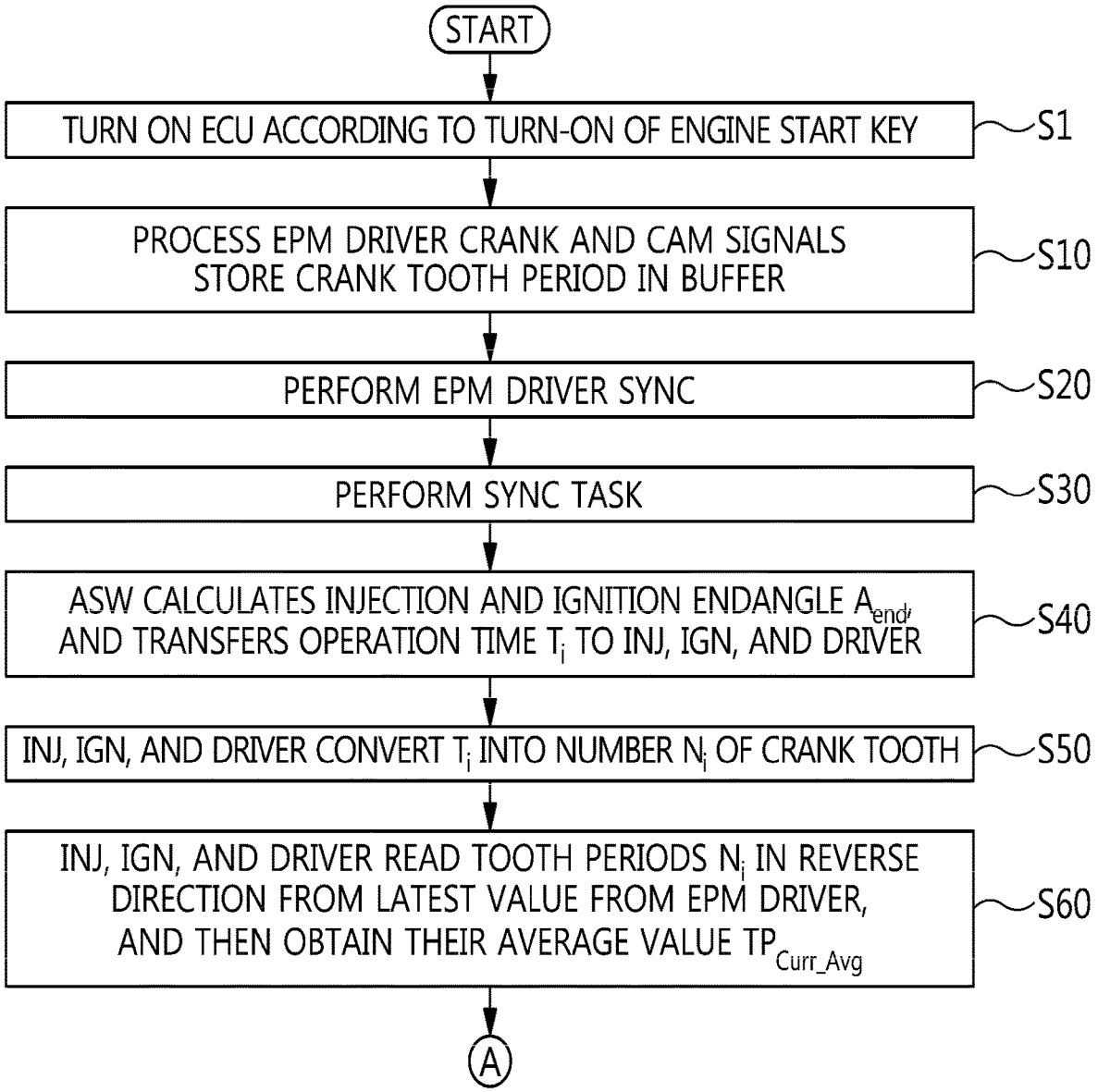
FIGS. 1A and 1B are a flowchart illustrating a method for engine control under an entire driving range of a vehicle based on control timing prediction.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, the present disclosure will be described in detail with reference to the accompanying exemplary drawings. However, the principles of the disclosure may be implemented in various different types by those of ordinary skill in the art to which the present disclosure pertains, and the present disclosure is not limited.

Figure 1B:
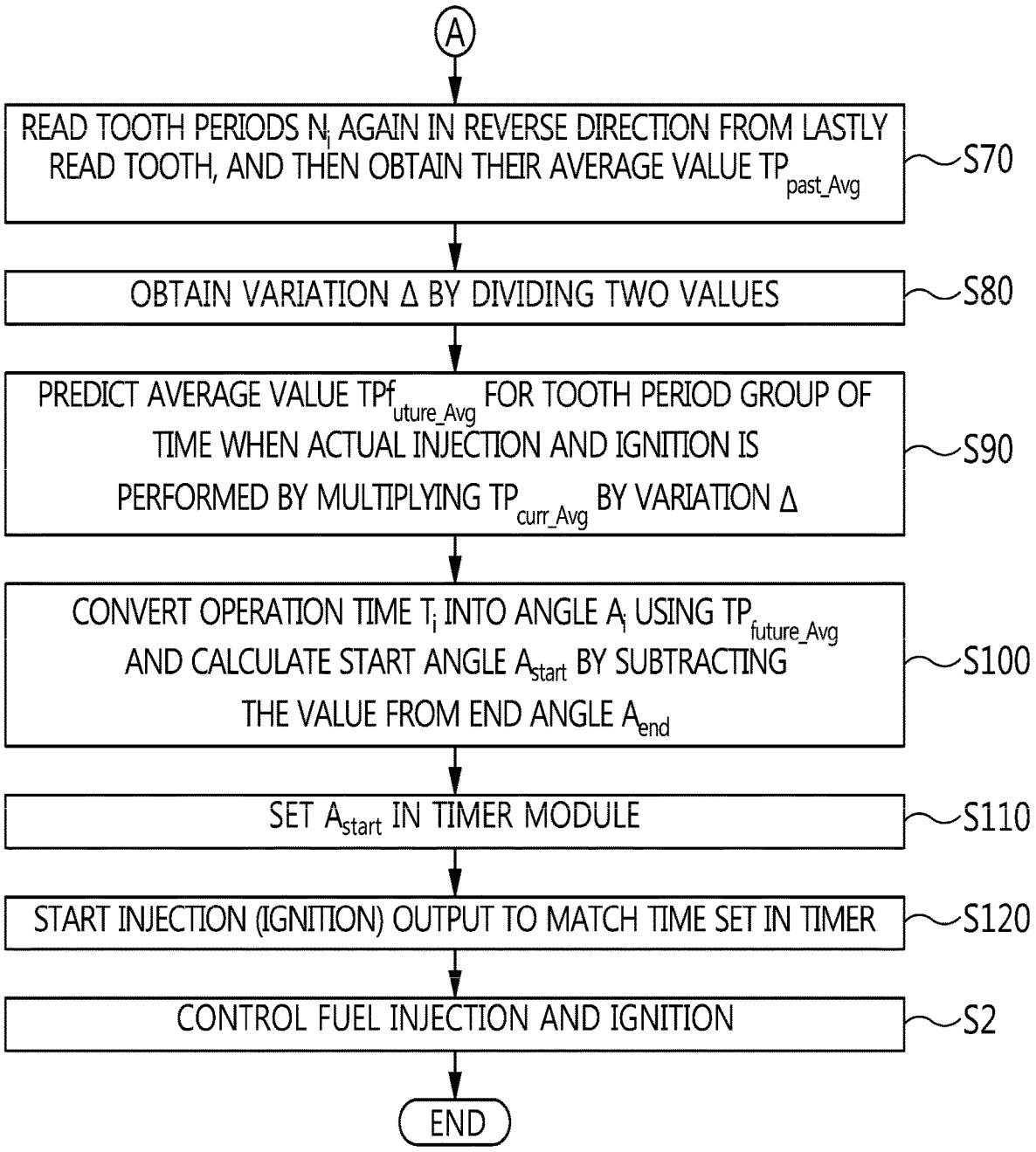

Referring to FIGS. 1A and 1B, a method for engine control under an entire driving range of a vehicle based on control timing prediction includes performing engine start information calculation control (S10 to S40), start angle operation time prediction control (S50 to S120), and fuel injection and ignition control (S2), which are performed at a sync task performing time after engine synchronization after an engine control unit is turned on (S1) through engine start key-on.

In particular, in performing the start angle operation time prediction control (S50 to S120), the most accurate operation time can be obtained through reading of a tooth period while the actual injection and ignition is performed, but, actually, calculation of the injection and ignition start time and timer setting should be performed before the actual operation time. As an example, the tooth period prediction control (S60 to S120) averages the tooth period (i.e., current tooth period) stored up to the current time (i.e., calculation time) and the tooth period (i.e., past tooth period) stored at the previous time, and predicts a tooth period (i.e., future tooth period) of a future time (i.e., operation time) when an actual fuel injection and ignition is performed. Accordingly, an accurate calculation value of the start angle can be obtained through an angle conversion of the operation time of the fuel injection and ignition to match the operation time rather than the calculation time.

As a result, according to the method for engine control based on control timing prediction, an engine RPM change situation in accordance with drivers' acceleration pedal operations having different patterns is reflected in the tooth period of the calculation time when the start angle of the fuel injection and ignition is calculated and the tooth period of the operation time when the actual injection and ignition occurs. Accordingly, in the method for engine control based on control timing prediction, it is possible to improve control of the engine occurring due to non-satisfaction of an end time and the operation time of the application software (ASW) (i.e., injector/igniter application software) of the engine control unit in case where the injection and ignition starts as it is at a resultant time derived from the calculation that does not reflect the pattern change of the tooth period at the calculation time and the operation time.

Figure 2:
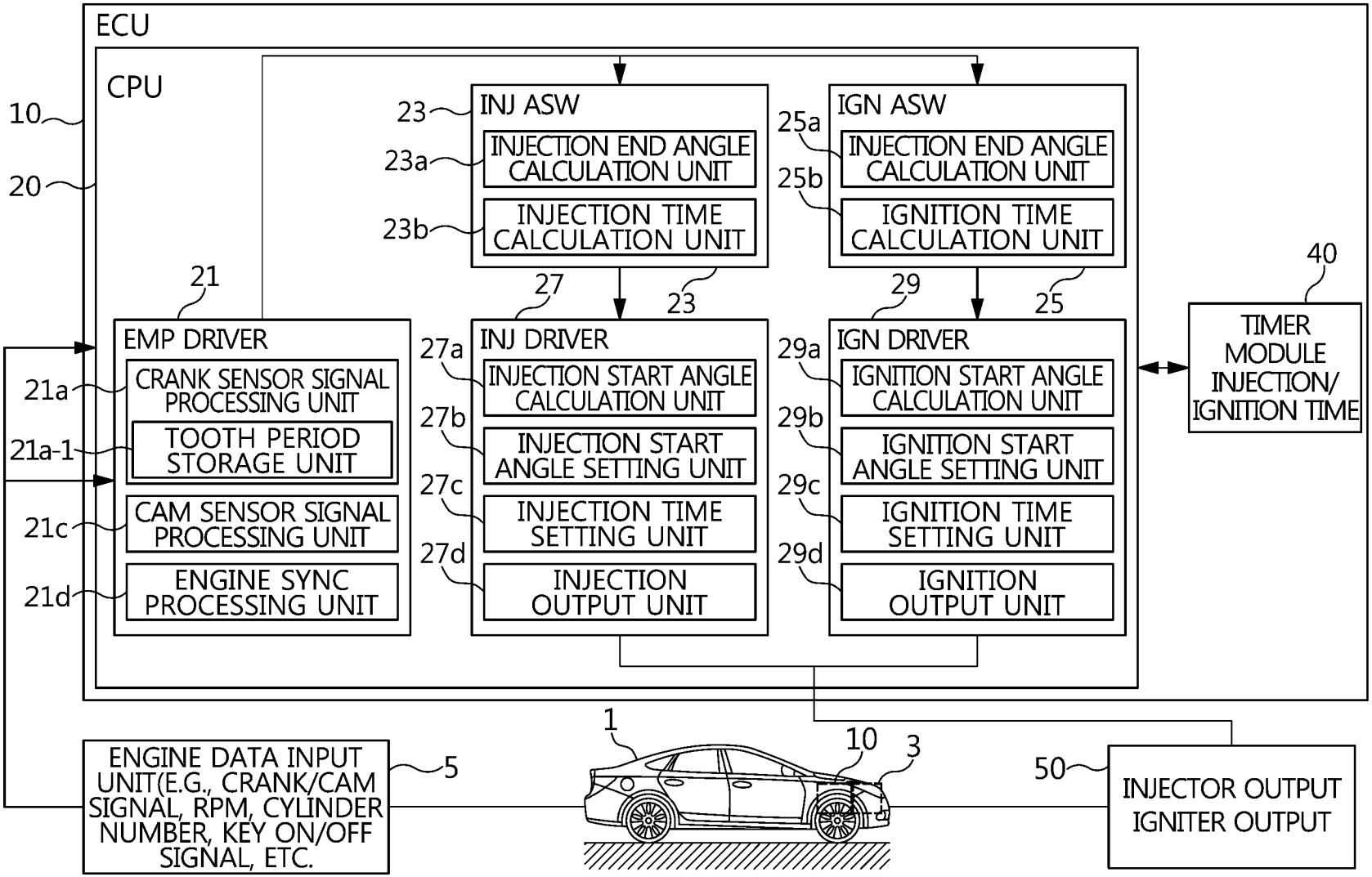
FIG. 2 is a diagram illustrating an example of a vehicle in which engine control based on control timing prediction is implemented.

Referring to FIG. 2, a vehicle 1 includes an engine control unit 10 that controls an engine 3 while receiving an input of information of an engine data input unit 5.

Specifically, the engine 3 is an internal combustion engine, and the engine data input unit 5 detects mount sensor information of the vehicle 1 including the engine 3, and transmits the detected information to the engine control unit 10. In this case, the mount sensor information includes a key on/off signal of the engine 3, a crank signal of a crank position sensor, a cam signal of a cam sensor, a cylinder number of the engine 3, an injector and igniter operation signal, and engine revolutions per minute.

Specifically, the engine control unit 10 includes a central processing unit 20 composed of an engine position management driver 21, injector application software 23, igniter application software 25, an injector driver 27, and an igniter driver 29, a timer module 40, and a signal output unit 50.

As an example, the engine position management driver 21 performs a sync task for performing time synchronization with respect to sensing values through the tooth of a crank target wheel attached to a crankshaft and an edge of a cam target wheel attached to a cam shaft. Further, the engine position management driver 21 stores in a buffer respective periods of the tooth as the tooth periods whenever the tooth is rotated.

As an example, the injector/igniter applications 23 and 25 calculate the end angle and the operation time of injection and ignition, and transfer the calculated end angle and operation time to the injector/igniter drivers 27 and 29. In this case, the operation time is derived through division of the number of crank teeth to pass during the operation time by the tooth period that is the time required for one tooth to be rotated, and through this, an angle conversion value corresponding to the operation time is derived by multiplying the number of teeth by the angle corresponding to one tooth (e.g., in case of the tooth crank target wheel having 60 teeth, one tooth is set to 6 degrees).

As an example, the injector/igniter drivers 27 and 29 receive the angle and the time that are transferred from the injector/igniter applications 23 and 25, and calculate the start angle of the injection and ignition by subtracting the value obtained by converting the operation time into the angle from the end angle. Further, the injector/igniter drivers 27 and 29 read the tooth period of the current time from the engine position management driver 21, predict the tooth period that matches the actual operation time based on the change tendency of the tooth period that matches the calculation time, and calculate the start angle of the fuel injection and ignition using the future tooth period obtained as the result of the prediction to set the calculated start angle in the timer module. Accordingly, it is possible to output the injection and ignition to match the set time of the timer module 40.

As an example, the timer module 40 performs setting of the start time of the fuel injection and ignition start transferred from the injector/igniter drivers 27 and 29. As an example, the signal output unit 50 outputs a fuel injection and ignition start signal toward the engine 3 to match the set start time.

Hereinafter, the method for engine control under an entire driving range of the vehicle based on control timing prediction of FIGS. 1A and 1B will be described in detail with reference to FIGS. 2 to 5. In this case, the control subject is the engine control unit 10, and the control target is the engine 3 in which the injector's injection and the igniter's ignition are performed through the signal output unit 50 of the engine control unit 10.

The engine control unit 10 performs engine control unit activation (S1). Referring to FIG. 2, the engine control unit 10 receives from the engine data input unit 5 a key on/off signal of the engine 3, a crank signal of a crank position sensor, a cam signal of a cam sensor, a cylinder number of the engine 3, an injector and igniter operation signal, and engine revolutions per minute. Accordingly, the engine control unit 10 is switched and activated to be in a turn-on state in association with a key-on signal of the engine 3.

Then, the engine control unit 10 performs engine start information calculation control (S10 to S40) including driver signal processing (e.g., crank signal and cam signal) (S10), driver sync (S20), driver sync task performing (S30), and application software (ASW) control factor (e.g., injection and ignition end angle Aend and operation time Ti) calculation.

As an example, the driver signal processing (S10) uses the crank signal and the cam signal among the information of the engine data input unit 5 for piston position calculation and determination in a cylinder of the engine 3. The driver sync (S20) corresponds to a piston position determination time in the cylinder. The driver sync task performing (S30) as many as the number of cylinders in one cycle of the engine 3 to follow the sync.

Referring to FIG. 2, a driver for the driver signal processing (S10), the driver sync (S20), and the driver sync task (S30) is an engine position management driver 21, and the engine position management driver 21 is composed of a crank sensor signal processing unit 21*a*, a cam sensor signal processing unit 21*b*, and an engine sync processing unit 21*c*. In particular, the crank sensor signal processing unit 21*a* is provided with a buffer 21*a*-1.

Specifically, the crank sensor signal processing unit 21*a* uses tooth sensing information of a crank target wheel attached to a crankshaft, and the cam sensor signal processing unit 21*b* uses edge sensing information of a cam target wheel attached to a camshaft. Through this, the position of the piston in the cylinder of the engine 3 is calculated and determined. In particular, the crank sensor signal processing unit 21*a* stores in the buffer 21*a*-1 respective periods of the tooth as the tooth periods whenever the tooth is rotated.

For example, if the RPM of the engine 3 is 1000 rpm, the rotating angle for 1 ms in one revolution of 360° is 6°. Accordingly, if it is assumed that the current RPM of the engine 3 is Xcurr, and the rotating angle for one tooth is 6°, the crank sensor signal processing unit 21*a* calculates (6×Xcurr)/1000 as the rotating angle (°) for 1 ms, (6×Xcurr×Ti)/1000 as the rotating angle (°) for the operation time Ti, and (6×Xcurr×Ti)/(1000×)D°) as the number Ni of teeth being rotated for the operation time Ti, respectively.

Specifically, the engine sync processing unit 21*c* determines the sync time by determining the sync (S20) using the position determination time of the piston in the cylinder of the engine 3, and performs the sync task after performing the sync by performing the sync task (S30) using the sync time. As an example, the sync task is performed as many as the number of cylinders for one cycle of the engine 3. In case of the 4-cylinder engine 3, the sync task is performed four times during two revolutions of the engine by an engine cycle, and the angle conversion of the performing position is performed at points of 0°, 180°, 360°, and 540°.

As an example, the application software (ASW) control factor calculation (S40) is performed in consideration of the respective injection and ignition angles $A_{end}$ and the operation times Ti of the injector and the igniter as control factors. In this case, the unit of the end angle $A_{end}$ is °, and the unit of the operation time Ti is ms.

Referring to FIG. 2, the application software (ASW) for the ASW control factor calculation (S40) corresponds to the injector application 23 and the igniter application 25, and the injector application 23 is composed of an injection end angle calculation unit 23*a* and an injection time calculation unit 23*b*, whereas the igniter application 25 is composed of an ignition end angle calculation unit 25*a* and an ignition time calculation unit 25*b*. Accordingly, the injector application 23 and the igniter application 25 consider the end angle $A_{end}$ and the operation time Ti as ASW calculation regions.

Specifically, the injection end angle calculation unit 23 a calculates the fuel injection end angle at the sync task performing time of the engine position management driver 21, and transfers the calculated fuel injection end angle to the injector driver 27. The injection time calculation unit 23*b* calculates the fuel injection operation time during performing of the sync task, and transfers the calculated fuel injection operation time to the injector driver 27. The ignition end angle calculation unit 25*a* calculates the ignition end angle during performing of the sync task, and transfers the calculated ignition end angle to the igniter driver 29. The ignition time calculation unit 25*b* calculates the ignition operation time during performing of the sync task, and transfers the calculated ignition operation time to the igniter driver 29.

Thereafter, the engine control unit 10 is switched to the start angle operation time prediction control (S50 to S120).

Figure 3:
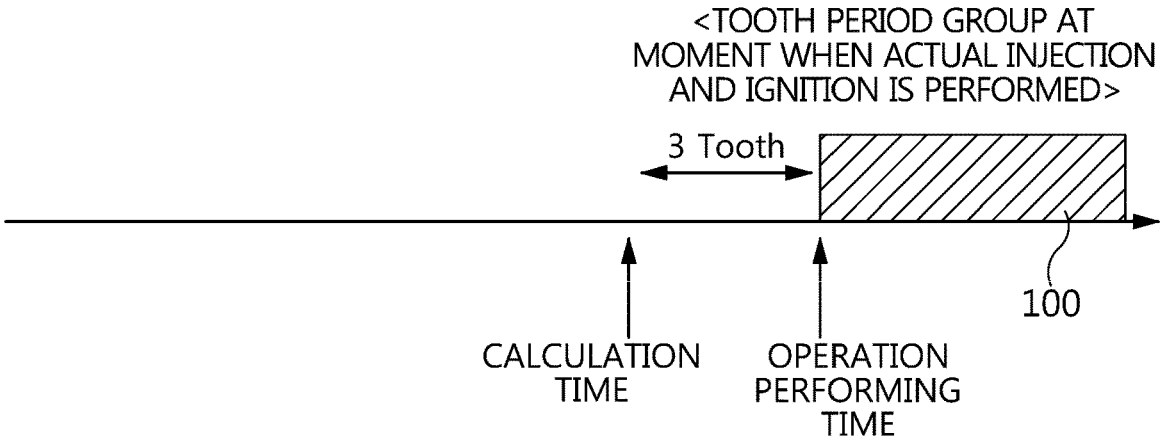
FIG. 3 is a diagram exemplarily illustrating a difference in tooth periods for engine control between a calculation time and an operation time.
Figure 4:
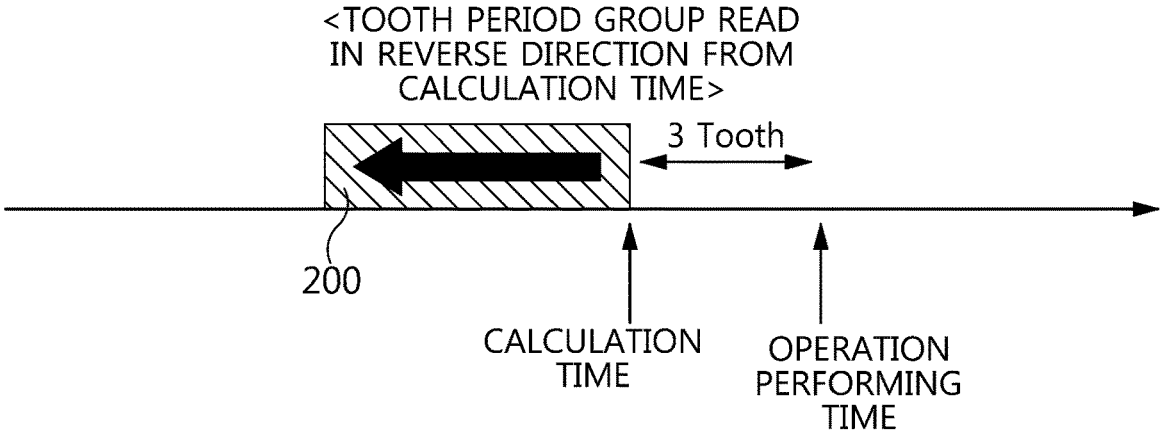
FIG. 4 is a diagram illustrating a case where a current tooth period is applied to a calculation time for engine control based on control timing prediction.
Figure 5:
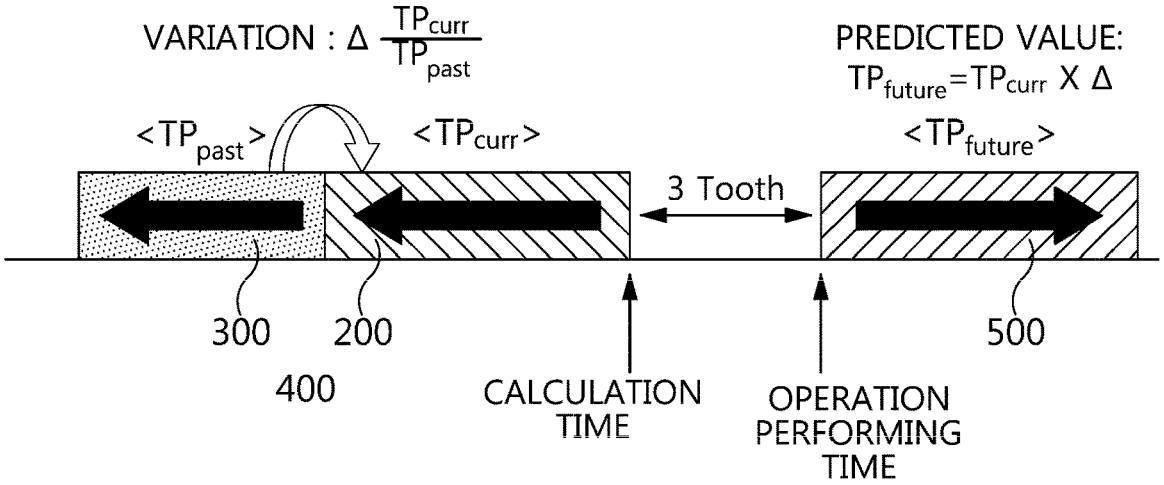
FIG. 5 is a diagram illustrating a case where a future tooth period of an operation time is calculated through application of a current tooth period and a past tooth period to a calculation time for engine control based on control timing.

FIGS. 3 to 5 illustrate an example in which the principle of the start angle operation time prediction control (S50 to S120) is applied to diagrams in which the calculation time and the operation time are illustrated with a difference of three teeth through division of a tooth period into a current tooth period, a past tooth period, and a future tooth period.

It can be known from FIG. 3 that the operation time that is a moment when the actual injection and ignition is performed has a difference of three teeth as compared with the calculation time, and it can be known from FIG. 4 that the angle conversion for the operation time Ti corresponds to an average value of the current tooth period read at the calculation time. For example, if a driver steps on an acceleration pedal more deeply, the time required for one tooth to be rotated becomes shorter, and thus an average value of tooth period groups of the operation time that is the moment when the actual operation is performed becomes smaller as compared with the calculation time even if the tooth period groups have the same number of tooth periods. That is, the angle for the operation time converted using the tooth period average value that is larger than the actual value becomes smaller than the actual value through division of the operation time by the tooth period average value, and thus the injection starts late due to the start angle calculated by the time later than the actual time. Through this, it is not possible to keep the injection end time required by the injector application 23 and the igniter application 25, or it is not possible to make sufficient charge with respect to an ignition coil. This is because the injection time has a priority with respect to the end time, and thus the injection is performed to satisfy the injection time even if the injection time exceeds the end time, whereas in contrast, the end time has a priority with respect to the charge time, and thus the charging is ended at the transferred end time even if the charge time is unable to be kept.

Accordingly, referring to FIG. 4, it is possible to calculate, as an accurate value as much as a difference of three teeth between the calculation time and the operation time, the average value obtained by reading a fixed number of tooth periods from the engine position management driver 21 so as to be applied to the angle conversion for the operation time Ti transferred from the injector application 23 and the igniter application 25 at the calculation time.

In contrast, referring to FIG. 5, the tooth period is exemplified as a tooth period group including a current tooth period, a past tooth period, and a future tooth period. Through the driver's acceleration pedal operation, it is possible to solve the difference between the past tooth period group read at the calculation time and the tooth period group of the time when the actual operation is to be performed. That is, through prediction of the tooth period group of the operation time when the actual operation is performed, it is possible to overcome the limitations of FIG. 4 that the calculation of the start time of the injection and ignition should be performed prior to the actual operation, and it is possible for the operation time to reflect the most accurate characteristics of FIG. 3 when the tooth period is read during performing of the actual injection and ignition.

Accordingly, the engine control unit 10 performs the start angle operation time prediction control (S50 to S120) in the prediction method of FIG. 5. Referring to FIG. 5, the current tooth period TPcurr is defined in the number of teeth Ni read in a reverse direction from the latest value in the buffer 21*a*-1, T(2Ni), T(2Ni−1), . . . , T(Ni+1) are formed as the current tooth period group 200, and the current tooth period average value TPurr_Avg is defined as "TPcurr_Avg=[T(2Ni)+T(2Ni−1)+, . . . , +T(Ni+1)]/Ni". The past tooth period TPpast is defined in the number of teeth Ni read again in the reverse direction from the last time read from the buffer 21*a*-1, T(Ni), T(Ni−1), . . . , T(1) are formed as the past tooth period group 300, and the past tooth period average value TPpast_Avg is defined as "TPpast_Avg=[T(Ni)+T(Ni−1)+ . . . , +T(1)]/Ni". The current tooth period group 200 and the past tooth period group 300 are defined as a variation tooth period group 400, and the tooth period group variation Δ is defined as "Δ=TPcurr_Avg/TPpast_Avg". A future tooth period group 500 to be applied at an operation time when the actual injection and ignition is to be performed predicts a future tooth period average value TPfuture_Avg, and the future tooth period average value TPfuture_Avg is defined as "TPfuture_Avg=TPcurr_Avg×Δ". A predicted angle Ai is an angle conversion value of the operation time Ti based on the future tooth period average value TPfuture_Avg, and is defined as "Ai=[Ti/TPfuture_Avg]×D°". The start angle Astart is an injection and ignition start angle, and is defined as "Astart=Aend−Ai".

Specifically, the start angle operation time prediction control (S50 to S120) includes the driver crank tooth calculation (S50), the current tooth period calculation (S60), the past tooth period calculation (S70), the tooth period variation Δ calculation (S80), the future tooth period calculation (S90), the driver start angle Astart calculation (S100), the timer module setting (S110), and the injection and ignition output control (S120).

The driver crank tooth calculation (S50) converts the number of teeth Ni of the crank tooth corresponding to the operation time Ti among the fuel injection and ignition end angle Aend and the operation time Ti that the injector driver 27 and the igniter driver 29 receive from the injector application 23 and the igniter application 25.

The current tooth period calculation (S60) calculates the current tooth period average value TPcurr_Avg through the current tooth period TPcurr defined as the number of teeth of Ni in the reverse direction from the latest one read using the index of the tooth period stored in the buffer 21*a*-1. The past tooth period calculation (S70) calculates the pas tooth period average value TPpast_Avg through the past tooth period TPpast defined as the number of teeth of Ni read again next to the teeth applied to the current tooth period TPcurr. The tooth period variation Δ calculation (S80) performs calculation by dividing the current tooth period average value TPcurr_Avg by the past tooth period average value TPpast_Avg. This is because the operation time comes fast mainly in the unit of 1 to 10 ms whereas the driver's acceleration pedal operation is relatively slow, the change tendency of the tooth period group corresponding to the operation time is limited to about 2 to 3 groups accordingly, and such a small group change may cause the tooth period change tendency at the calculation time to be continued up to the actual injection and ignition operation time. The future tooth period calculation (S90) calculates the future tooth period average value TPfuture_Avg as a value obtained by multiplying the current tooth period average value TPcurr_Avg by the tooth period group variation Δ, and applies the future tooth period average value TPfuture_Avg as the future tooth period of the operation time when the actual operation is to be performed.

The driver start angle Astart calculation (S100) converts the predicted angle Ai by dividing the operation time Ti transferred from the injector application 23 and the igniter application 25 by the future tooth period average value TPfuture_Avg, and then calculates the injection and ignition start angle Astart by subtracting the predicted angle Ai from the end angle Aend transferred from the injector application 23 and the igniter application 25. The timer module setting (S110) sets the start angle Astart in the timer module 40. The injection and ignition output control (S120) starts the injection and ignition output to match the time set in a timer of the timer module 40.

On the other hand, referring again to FIG. 2, the signal output unit 50 supplies injection and ignition output signals of the injector driver 27 and the igniter driver 29 as the injector and igniter outputs, and as a result, the signal output unit 50 is switched to the fuel injection and ignition control (S2) of FIG. 1 in which the engine 3 is operated.

As described above, the method for engine control based on control timing prediction of a vehicle may reduce the start angle error calculated at the calculation time prior to the operation time when the actual injection and ignition is performed by grasping the tooth period change tendency for the tooth period of the current time that injector/igniter drivers 27 and 29 of the engine control unit 10 read from the engine position management driver 21 and calculating the start angle of fuel injection and ignition through prediction of the tooth period to match the actual operation time. In particular, since the tooth period prediction to match the actual operation time is based on the change tendency of the tooth period stored up to the current time, the injection and ignition time can effectively reflect the engine operation situation in which the engine RPM is changed during vehicle drive.

While the present disclosure has been described with respect to specific examples, it will be apparent to those skilled in the art that various changes and modifications may be made without departing from the spirit and scope of the disclosure.

What is claimed is:

1. A method for engine control based on control timing prediction, comprising:

when an engine control unit is activated to enter into a start angle operation time prediction control under an entire driving range of a vehicle, by the engine control unit, performing the start angle operation time prediction control including calculating a crank tooth corresponding to an operation time of fuel injection and of ignition converting into a number of teeth corresponding to the operation time;

calculating a tooth period average value that is divided into a current tooth period average value and a past tooth period average value through a number of teeth read in a reverse direction from the latest calculation time;

calculating a tooth period variation from the tooth period average value;

calculating a future tooth period average value that matches the tooth period of the operation time from the tooth period average value and the tooth period variation multiplying the current tooth period average value by a tooth period group variation;

calculating a start angle corresponding to the operation time of the fuel injection and ignition by subtracting a predicted angle corresponding to the operation time from an end angle of the fuel injection and ignition; and performing an injection and ignition output at the start angle, wherein:

the tooth period of the calculation time is calculated using an end angle and the operation time of the fuel injection and ignition, and the end angle and the operation time are calculated by performing engine start information calculation control, and performing the engine start information calculation control comprises:

performing, by the engine control unit, driver sync confirmation and sync task performing with a crank signal and a cam signal of the engine, calculating the end angle and the operation time at a time of the sync task performing, and confirming the end angle and the operation time through the start angle operation time prediction control.

2. The method according to claim 1, wherein activation of the engine control unit is performed through on-conversion by key-on of the engine, and the start angle operation time prediction control predicts the start angle through the calculation time and the operation time.

3. The method according to claim 1, the current tooth period average value is calculated in consideration of the number of teeth grasped in the reverse direction from the latest calculation time as the current tooth period, and the past tooth period average value is calculated in consideration of the number of teeth grasped before the current tooth period as the past tooth period.

4. The method according to claim 1, wherein the tooth period variation is calculated by dividing the current tooth period average value by the past tooth period average value.

5. The method according to claim 1, wherein the predicted angle is calculated by dividing the operation time by the future tooth period average value.

6. The method according to claim 1, wherein the start angle is set in a timer, and the injection and ignition output is performed to match a set time of the timer.

7. The method according to claim 1, wherein the crank signal is tooth sensing information of a crank target wheel attached to a crankshaft, and the cam signal is edge sensing information of a cam target wheel attached to a cam shaft.

8. The method according to claim 7, wherein the sync confirmation is performed at a position determination time of a piston in a cylinder of the engine, and the sync task performing is performed as many as a number of cylinders in one cycle of the engine.

9. A vehicle comprising:

an engine control unit configured to:

perform a start angle operation time prediction control under an entire driving range of the vehicle, calculate a crank tooth corresponding to an operation time of fuel injection and of ignition by converting into a number of teeth corresponding to the operation time, calculate a tooth period average value that is divided into a current tooth period average value and a past tooth period average value through a number of teeth read in a reverse direction from the latest calculation time, calculate a tooth period variation from the tooth period average value, calculate a future tooth period average value that matches the tooth period of the operation time from the tooth period average value and the tooth period variation by multiplying the current tooth period average value by a tooth period group variation, calculate a start angle corresponding to the operation time of the fuel injection and ignition by subtracting a predicted angle corresponding to the operation time from an end angle of the fuel injection and ignition, perform driver sync confirmation and sync task performing with a crank signal and a cam signal of the engine, calculate the end angle and the operation time at a time of the sync task performing, and confirm the end angle and the operation time through the start angle operation time prediction control, wherein the engine control unit comprises: an engine position management driver, an injector application, an ignition application, an injector driver, and an igniter driver, wherein the injector driver and the igniter driver read a tooth period of a current time from the engine position management driver, and calculate a start angle of fuel injection and ignition in a future tooth period to match an actual operation time based on a tooth period change tendency of a calculation time, and wherein the tooth period of the calculation time is calculated using an end angle and the operation time of the fuel injection and ignition, and the end angle and the operation time are calculated by performing engine start information calculation control.

10. The vehicle according to claim 9, wherein the engine position management driver is provided with a buffer configured to store the tooth period as an index.

11. The vehicle according to claim 9, the engine control unit comprises a timer module, and the timer module sets a start angle timer time for an injection and ignition output with calculation values of the injector driver and the igniter driver.

* * * * *